US008893531B2

(12) United States Patent
Mun et al.

(10) Patent No.: US 8,893,531 B2
(45) Date of Patent: Nov. 25, 2014

(54) WASHING MACHINE

(75) Inventors: Il Jun Mun, Suwon-si (KR); Eung Yeoul Yoon, Suwon-si (KR); Kyu Ho Shin, Seoul (KR); Kwang Hyok Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/337,739

(22) Filed: Dec. 27, 2011

(65) Prior Publication Data

US 2012/0167637 A1 Jul. 5, 2012

(30) Foreign Application Priority Data

Jan. 4, 2011 (KR) ..... 10-2011-0000664

(51) Int. Cl.
*D06F 39/02* (2006.01)
*D06F 39/08* (2006.01)

(52) U.S. Cl.
CPC ..... *D06F 39/02* (2013.01)
USPC ..... 68/17 R; 68/12.18; 68/13 R

(58) Field of Classification Search
USPC ..... 68/13 R, 12.18
See application file for complete search history.

(56) References Cited

U.S. PATENT DOCUMENTS

2008/0072631 A1* 3/2008 Je et al. ..... 68/17 R

FOREIGN PATENT DOCUMENTS

| | | | |
|---|---|---|---|
| EP | 1 449 952 | A1 | 8/2004 |
| EP | 1 903 137 | A2 | 3/2008 |
| KR | 10-2007-0059437 | | 6/2007 |
| KR | 10-2008-0027677 | | 3/2008 |
| KR | 20-0442445 | | 10/2008 |
| WO | 03/044256 | A1 | 5/2003 |

OTHER PUBLICATIONS

European Search Report dated May 10, 2013 and issued in corresponding European Patent Application 11195588.6.

* cited by examiner

*Primary Examiner* — Joseph L Perrin
*Assistant Examiner* — Levon J Shahinian
(74) *Attorney, Agent, or Firm* — Staas & Halsey LLP

(57) ABSTRACT

A washing machine including a detergent feeding device to feed detergent. The detergent feeding device includes a detergent housing having an open front side, a detergent receiving case installed to the detergent housing to move through the open front side of the detergent housing, and a water supply guide unit placed on the detergent housing to guide water into the detergent receiving case inserted into the detergent housing. The detergent receiving case includes at least one support roller supported in a rolling manner on a lower surface of the water supply guide unit, and an auxiliary support member located forward of the support roller to be supported in contact with a bottom surface of the detergent housing as the detergent receiving case is withdrawn. The support roller and the auxiliary support member may prevent vertical movement of the detergent receiving case during withdrawal or insertion of the detergent receiving case.

15 Claims, 8 Drawing Sheets

WASHING MACHINE

CROSS-REFERENCE TO RELATED APPLICATIONS

This application claims the priority benefit of Korean Patent Application No. 10-2011-0000664, filed on Jan. 4, 2011 in the Korean Intellectual Property Office, the disclosure of which is incorporated herein by reference.

BACKGROUND

1. Field

Embodiments relate to a washing machine having a detergent feeding device to feed detergent.

2. Description of the Related Art

Generally, a washing machine includes a water tub in which water is received, and a rotating tub rotatably installed in the water tub. As the rotating tub in which laundry is received is rotated within the water tub, washing of the laundry is carried out.

The washing machine is equipped with a detergent feeding device. In recent years, the detergent feeding device has been designed to feed detergent for use in washing of laundry into the water tub.

The detergent feeding device includes a detergent housing mounted in a main body of the washing machine and a detergent receiving case movably inserted in the detergent housing so as to protrude from the main body upon movement thereof. The detergent receiving case internally defines a detergent receiving region in which detergent is received.

As such, after the detergent receiving case is pulled out of the detergent housing to expose the detergent receiving region to the outside, the user may pour detergent into the detergent receiving region.

SUMMARY

Therefore, it is an aspect of one or more embodiments to provide a washing machine having a detergent feeding device to achieve more easy movement of a detergent receiving case.

Additional aspects of one or more embodiments will be set forth in part in the description which follows and, in part, will be apparent from the description, or may be learned by practice.

In accordance with an aspect of one or more embodiments, a washing machine includes a detergent feeding device to feed detergent, wherein the detergent feeding device includes a detergent housing having an open front side, a detergent receiving case installed to the detergent housing so as to be movable through the open front side of the detergent housing, and a water supply guide unit placed on top of the detergent housing to guide water into the detergent receiving case inserted into the detergent housing, and wherein the detergent receiving case includes at least one support roller supported in a rolling manner on a lower surface of the water supply guide unit, and an auxiliary support member located forward of the support roller, the auxiliary support member being supported in contact with a bottom surface of the detergent housing as the detergent receiving case is withdrawn from the detergent housing.

The auxiliary support member may include an auxiliary support roller supported in a rolling manner on the bottom surface of the detergent housing.

The auxiliary support member may include an auxiliary support portion integrally extending from the detergent receiving case.

The detergent receiving case may include a partition to divide the interior of the detergent receiving case into left and right regions, and a roller mount indented in the partition for installation of the support roller.

The detergent receiving case may further include a stopper located forward of the support roller, the stopper serving to limit a withdrawal distance of the detergent receiving case.

The partition may include elongated slots formed in an upper surface thereof at opposite sides of the stopper to extend in a front-and-rear direction thereof.

The detergent housing may include first rail portions provided at opposite inner surfaces of the detergent housing, to which the detergent receiving case is movably installed, and the detergent receiving case may include second rail portions provided at opposite outer surfaces thereof so as to be movably installed respective to the first rail portions.

The at least one support roller may include two support rollers, and roller mounts for installation of the two support rollers may be provided at opposite lateral positions of the detergent receiving case.

The detergent housing may include an inclined guide extending forwardly and upwardly from an inner bottom surface of the detergent housing so that the auxiliary support member is supported in contact with the inclined guide.

A lower end of the auxiliary support member to be supported in contact with the inclined guide may be curved.

In accordance with another aspect of one or more embodiments, a washing machine includes a detergent feeding device to feed detergent, wherein the detergent feeding device includes a detergent housing having open front and top sides, a detergent receiving case installed to the detergent housing so as to be movable through the open front side of the detergent housing, the detergent receiving case internally providing a detergent receiving region in which detergent is received, and a water supply guide unit installed to the detergent housing so as to cover the top side of the detergent housing, the water supply guide unit serving to guide water into the detergent receiving region of the detergent receiving case inserted into the detergent housing, wherein the detergent housing includes first rail portions provided at opposite inner surfaces of the detergent housing, to which the detergent receiving case is movably installed, and wherein the detergent receiving case includes second rail portions provided at opposite outer surfaces thereof so as to be movably installed respective to the first rail portions, and at least one support roller rotatably installed to the detergent receiving case so as to support a lower surface of the water supply guide unit.

BRIEF DESCRIPTION OF THE DRAWINGS

These and/or other aspects of one or more embodiments will become apparent and more readily appreciated from the following description of embodiments, taken in conjunction with the accompanying drawings of which.

DETAILED DESCRIPTION

Figure 1:
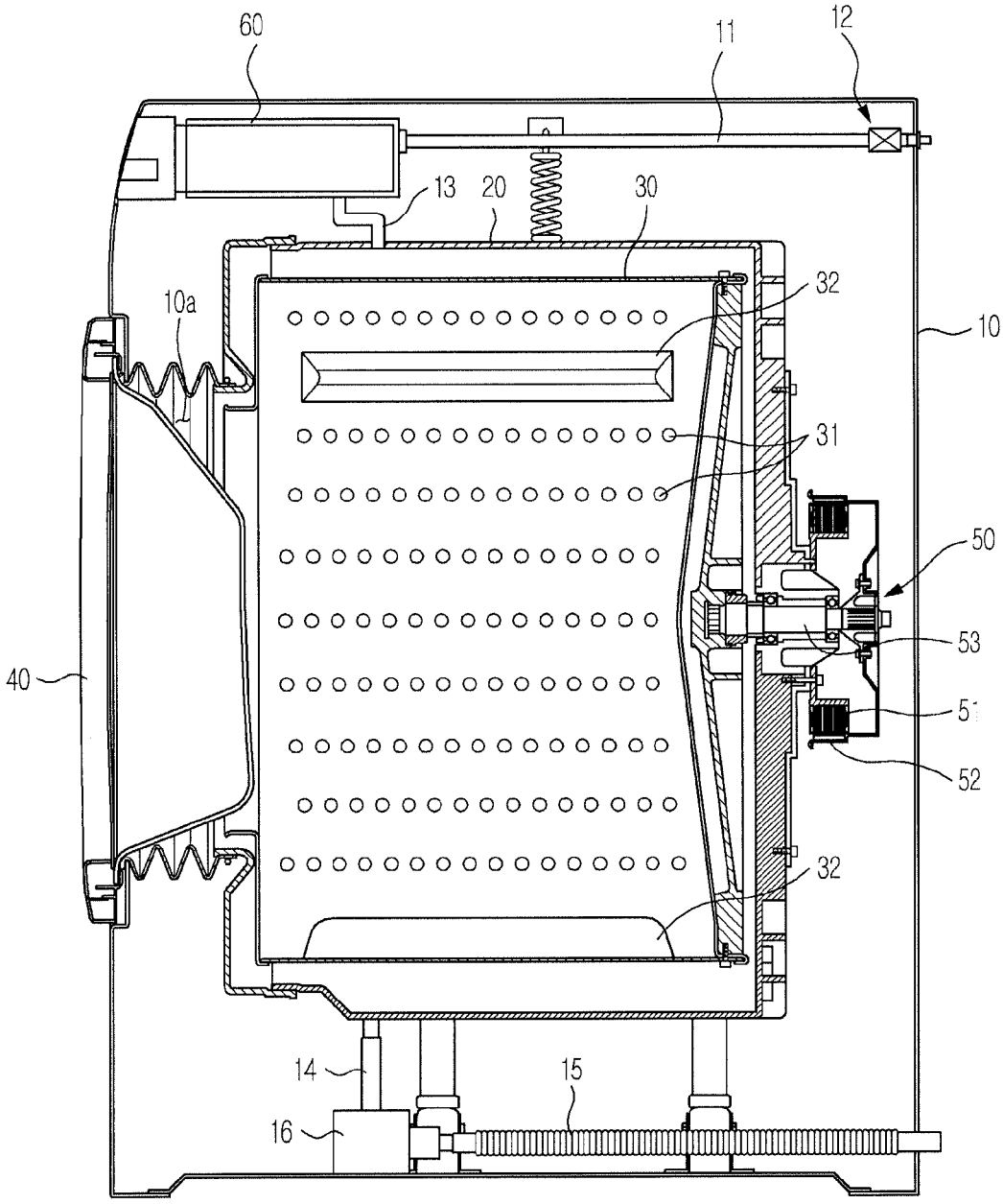
FIG. 1 is a schematic view of a washing machine according to an embodiment.

Reference will now be made in detail to an exemplary embodiment, examples of which are illustrated in the accompanying drawings, wherein like reference numerals refer to like elements throughout.

In the present embodiment, a drum washing machine, which realizes washing of laundry by rising and falling of laundry, will be described by way of example.

The washing machine according to an embodiment, as illustrated in FIG. 1, includes a main body 10 defining an external appearance thereof, a water tub 20 suspended in the main body 10, in which water is received, a rotating tub 30 rotatably installed in the water tub 20, a door 40 to open or close a laundry input opening 10*a*, and a drive motor 50 installed to a rear surface of the water tub 20 to generate rotational power required to rotate the rotating tub 30.

As such, as the rotating tub 30 is rotated by the drive motor 50 after the door 40 is opened to input laundry into the rotating tub 30 through the input opening 10*a*, laundry in the rotating tub 30 is raised and then falls repeatedly, whereby the laundry is washed.

The rotating tub 30 is provided with communication holes 31 for passage of water from the water tub 20 into the rotating tub 30. Lifters 32 to raise laundry are arranged at an inner surface of the rotating tub 30.

A water supply pipe 11 to supply water into the water tub 20, a water supply valve 12 to open or close the water supply pipe 11, a detergent feeding device 60 to add detergent in to the water supplied through the water supply pipe 11, and a water supply hose 13 connected between the detergent feeding device 60 and the water tub 20 to guide the water and detergent into the water tub 20, are arranged above the water tub 20. A drain pipe 14 and a drain hose 15 to discharge wash water to the outside after completion of washing of laundry, and a drain pump 16 placed between the drain pipe 14 and the drain hose 15, are arranged below the water tub 20.

The drive motor 50 includes a stator 51 installed to the water tub 20, a rotator 52 to be rotated by interaction with the stator 51, and a rotating shaft 53 having one end installed to the rotator 52 and the other end penetrating the rear surface of the water tub 20 to thereby be installed to the rotating tub 30, the rotating shaft 53 allowing the rotating tub 30 to be rotated along with the rotator 52.

Figure 2:
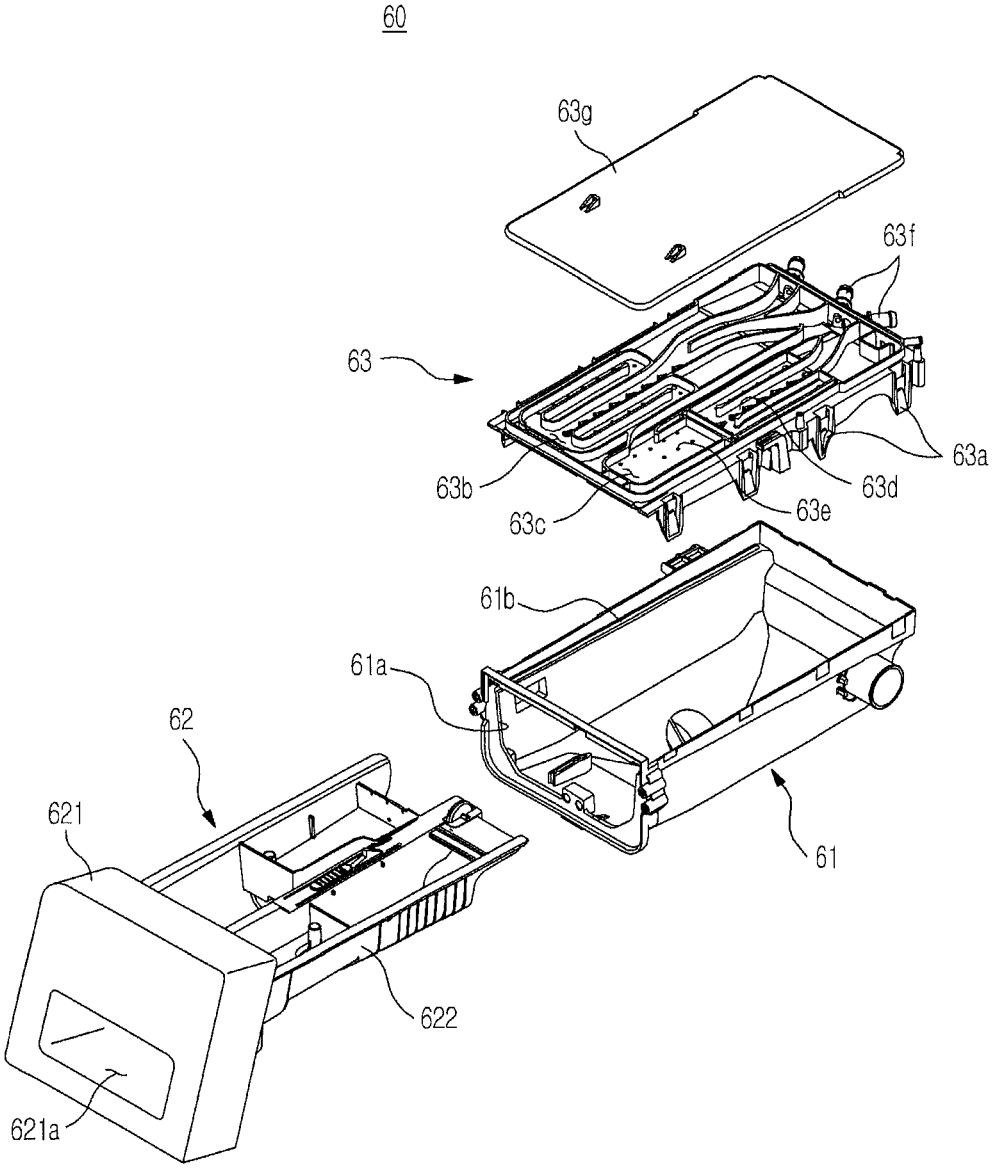
FIG. 2 is an exploded perspective view of a detergent feeding device usable with the washing machine according to an embodiment.
Figure 3:
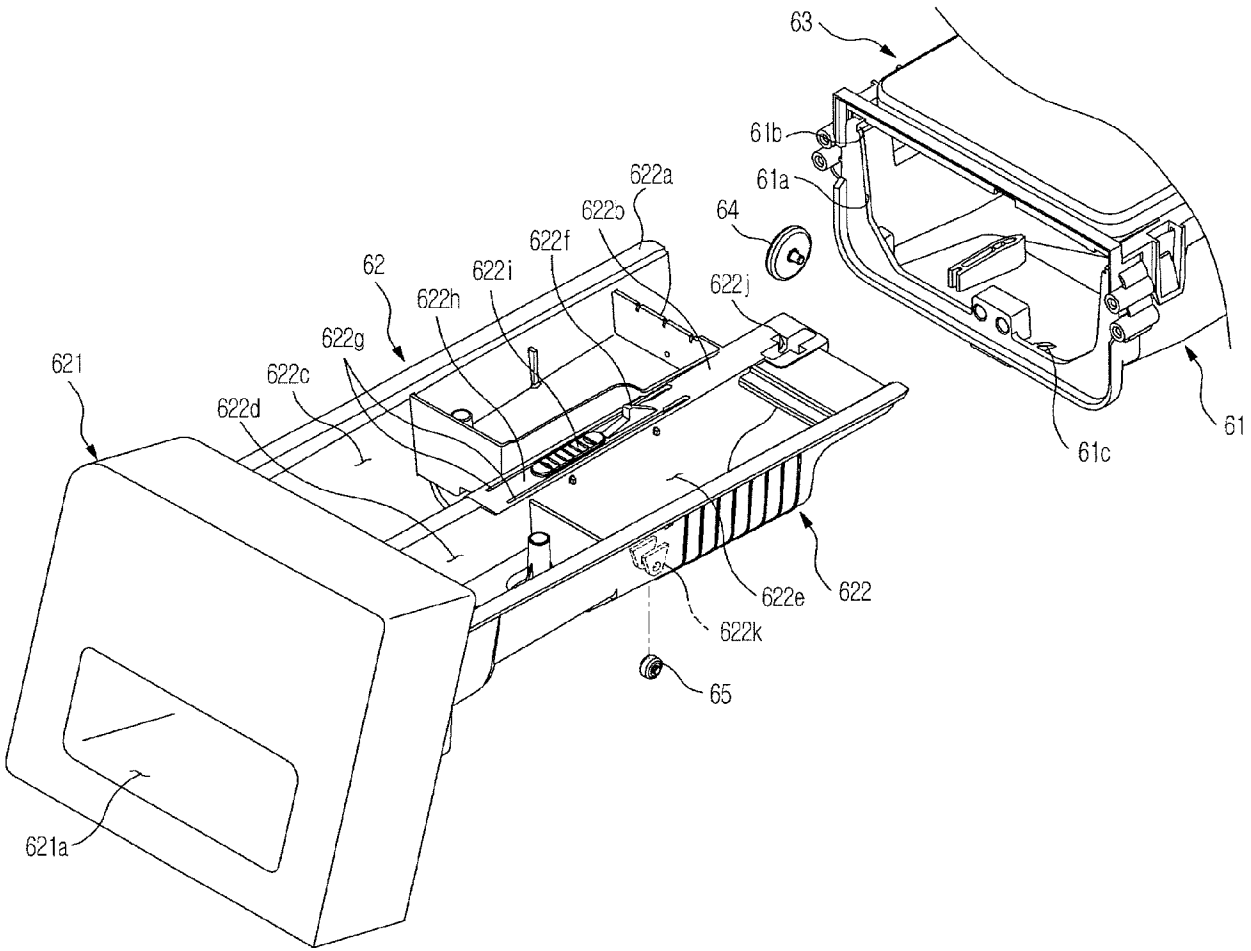
FIG. 3 is a perspective view illustrating a detergent receiving case installed in the washing machine according to an embodiment.

The detergent feeding device 60, as illustrated in FIGS. 2 and 3, includes a detergent housing 61 mounted in the main body 10, a detergent receiving case 62 movably accommodated in the detergent housing 61, the detergent receiving case 62 internally defining detergent receiving regions 622*c*, 622*d* and 622*e*, and a water supply guide unit 63 mounted on an upper end of the detergent housing 61 to supply water into detergent received in the detergent receiving case 62.

To movably install the detergent receiving case 62 to the detergent housing 61, the detergent housing 61 is provided at opposite inner lateral surfaces thereof with first rail portions 61*b* to which the detergent receiving case 62 is slidably installed, and the detergent receiving case 62 is provided at opposite lateral sides thereof with second rail portions 622*a* to be movably installed to the first rail portions 61*b*.

The detergent housing 61 is mounted stationary in the main body 10. The front side of the detergent housing 61 is open to form an opening 61*a*, through which the detergent receiving case 62 is withdrawn or inserted in. The top of the detergent housing 61 is open for installation of the water supply guide unit 63.

The detergent receiving case 62 includes a front cover 621 defining a front surface of the detergent receiving case 62, and a tray 622 provided at the rear of the front cover 621 so as to be received in the detergent housing 61. The front cover 621 is provided with a grip recess 621*a* to assist the user to easily apply force to the detergent receiving case 62. The above-described detergent receiving regions 622*c*, 622*d* and 622*e* are defined in the tray 622. The interior of the tray 622 is divided into left and right regions by a front-and-rear extending partition 622*b* such that one region includes a main detergent receiving region 622*c* in which main detergent is received and the other region includes non-detergent receiving regions 622*d* and 622*e* in which non-detergents, such as fabric softener and bleach, are received. In an embodiment, the non-detergent receiving regions 622*d* and 622*e* are divided into a fabric softener receiving region 622*d* in which fabric softener is received and a bleach receiving region 622*e* in which bleach is received.

The detergent receiving case 62 is provided with a stopper 622*f* to limit a withdrawal distance of the detergent receiving case 62. The stopper 622*f* integrally extends from an upper surface of the partition 622*b* and is configured to be caught by a front lower end of the water supply guide unit 63 that is installed to cover the top of the detergent housing 61.

The detergent receiving case 62 is completely separable from the detergent housing 61. To this end, slits 622*g* are formed at opposite sides of the stopper 622*f* on the partition 622*b* to define an elastic deformable portion 622*h* between the slits 622*g*. The elastic deformable portion 622*h* may be temporarily elastically deformed upon receiving external force. The elastic deformable portion 622*h* is provided with a pressure portion 622*i* to assist the user to easily apply force to the elastic deformable portion 622*h*. As such, if the user pushes the pressure portion 622*i* to apply force downward to the elastic deformable portion 622*h*, the elastic deformable portion 622*h* is temporarily deformed downward, causing the stopper 622*f* to be temporarily moved downward. If the detergent receiving case 62 is moved forward in such a state, the detergent receiving case 62 may be completely separated from the detergent housing 61.

The water supply guide unit 63 is installed on the detergent housing 61 by a plurality of hooks 63*a* provided at an outer edge thereof. The water supply guide unit 63 is provided at a rear end thereof with a water supply port 63*f* that is connected to the water supply pipe 11. A plurality of water supply paths 63*b*, 63*c* and 63*d* to supply water into the detergent receiving regions 622*c*, 622*d* and 622*e*, respectively, are defined in the water supply guide unit 63. In addition, water supply holes 63*e* are perforated in the bottom of the water supply guide unit 63 to allow the water guided by the water supply paths 63*b*, 63*c* and 63*d* to be supplied into the detergent receiving regions 622*c*, 622*d* and 622*e*. A cover plate 63*g* is coupled to the water supply guide unit 63 to close the water supply paths 63*b*, 63*c* and 63*d*.

In the detergent receiving case 62 having the above-described configuration, in a state in which half or more of the detergent receiving case 62 is withdrawn, the center of gravity of the detergent receiving case 62 is shifted forward of the detergent housing 61. In this case, the detergent receiving case 62 is slightly tilted forward by the weight thereof as well as the weight of detergent received therein, whereby a front end of the detergent receiving case 62 sags. In the event that the front end of the detergent receiving case 62 sags, friction between the first rail portions 61*b* and the second rail portions 622*a* increases. This may hinder smooth withdrawal of the detergent receiving case 62 for the latter half of the withdrawal operation of the detergent receiving case 62.

Accordingly, to prevent the detergent receiving case 62 from sagging as described above, a support roller 64 is provided at the detergent receiving case 62, to allow a rear end of the detergent receiving case 62 to be supported in a rolling manner by a lower surface of the water supply guide unit 63 located above the detergent receiving case 62. In this case, as the withdrawal distance of the detergent receiving case 62 is determined by the above-described stopper 622*f*, it may be necessary to position the support roller 64 behind the stopper 622*f* in order to prevent sagging of the detergent receiving case 62.

In an embodiment, for installation of the support roller 64, a roller mount 622*j* is indented in the partition 622*b* of the detergent receiving case 62 so that the support roller 64 is rotatably seated in the roller mount 622*j*. In such a seated state, an upper end of the support roller 64 protrudes from the roller mount 622*j* so that the protruding portion of the support roller 64 is supported by the lower surface of the water supply guide unit 63.

Figure 4:
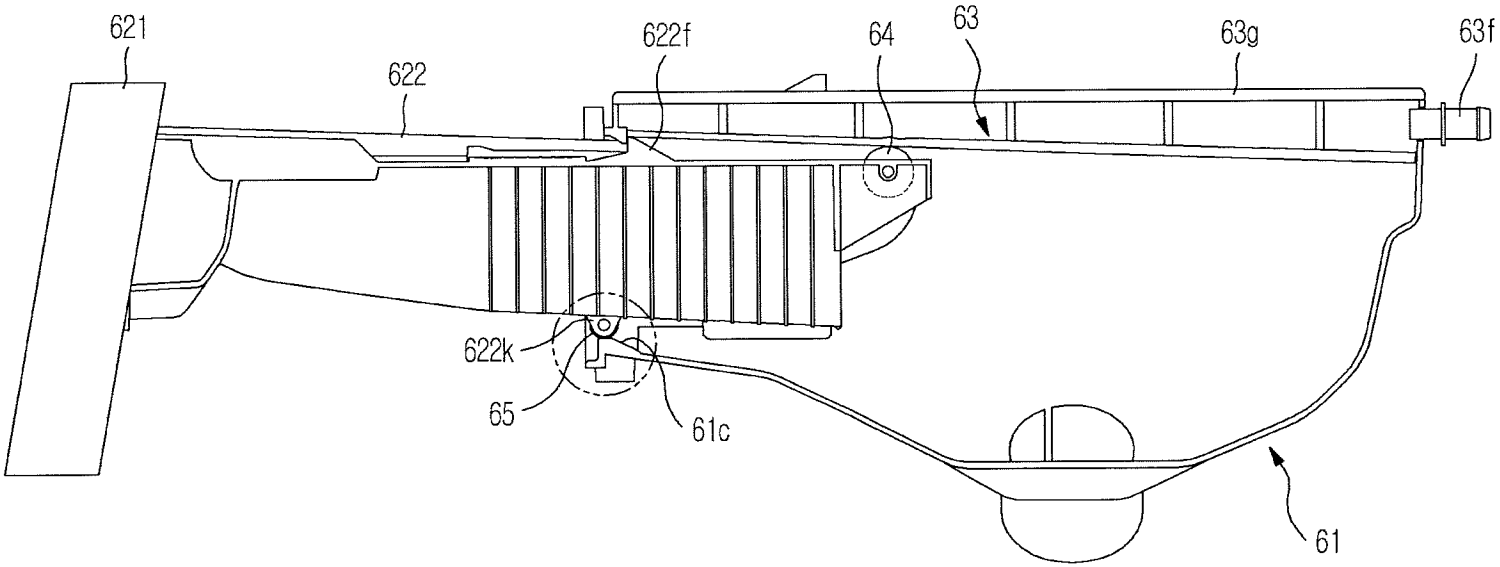
FIG. 4 is a side sectional view of the detergent feeding device usable with the washing machine according to an embodiment.

As such, even if the center of gravity of the detergent receiving case 62 is shifted forward of the detergent housing 61 as the detergent receiving case 62 is withdrawn, the rear end of the detergent receiving case 62 is supported by the lower surface of the water supply guide unit 63 via the support roller 64 as illustrated in FIG. 4, whereby the support roller 64 prevents the detergent receiving case 62 from sagging and consequently, friction between the first rail portions 61*b* and the second rail portions 622*a* does not increase. Moreover, although load applied to the support roller 64 increases as the detergent receiving case 62 is withdrawn, low friction is present between the support roller 64 and the lower surface of the water supply guide unit 63 because the support roller 64 is supported in a rolling manner by the lower surface of the water supply guide unit 63. This ensures that the detergent receiving case 62 is easily movable so as to be withdrawn from the detergent housing 61.

For the latter half of the withdrawal operation of the detergent receiving case 62, the front end of the detergent receiving case 62 may be raised by force applied by the user. Even in the event that the front end of the detergent receiving case 62 is raised, friction between the first rail portions 61*b* and the second rail portions 622*a* increases, which may hinder smooth withdrawal of the detergent receiving case 62 for the latter half of the withdrawal operation of the detergent receiving case 62.

Figure 5:
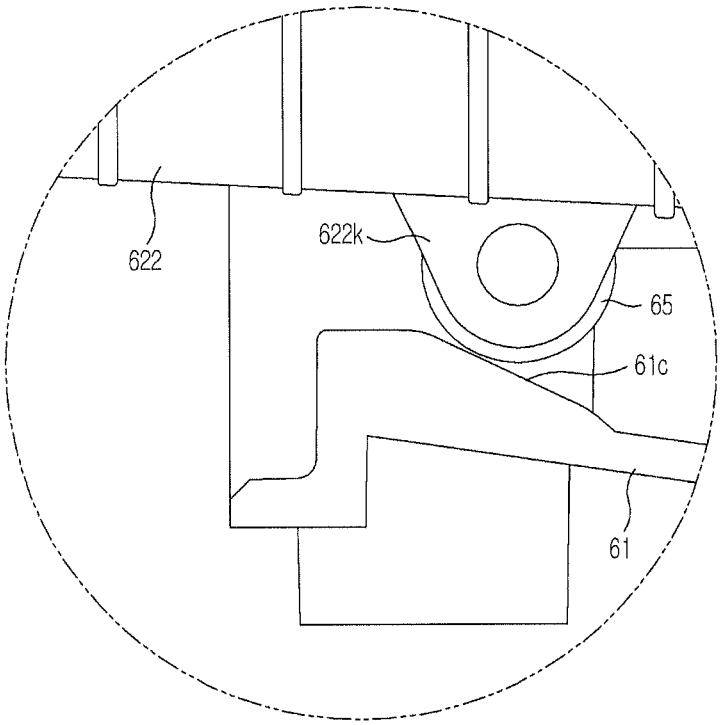
FIG. 5 is an enlarged view of an auxiliary support roller illustrated in FIG. 4.

Accordingly, to prevent rising of the detergent receiving case 62 that occurs for the latter half of the withdrawal operation of the detergent receiving case 62, the detergent housing 61 is provided at a front end of an inner bottom surface thereof with a forwardly and upwardly inclined guide 61*c*, and the detergent receiving case 62 is provided at a lower surface thereof with an auxiliary support member 65 to be supported by the inclined guide 61*c* as the detergent receiving case 62 is withdrawn. In an embodiment, the auxiliary support member 65 includes an auxiliary support roller 65 rotatably installed to the lower surface of the detergent receiving case 62. The auxiliary support roller 65 is located at a position corresponding to the stopper 622*f*, so as to be supported by the inclined guide 61*c* for the latter half of the withdrawal operation of the detergent receiving case 62. That is, the auxiliary support roller 65 is located forward of the support roller 64. In an embodiment, the auxiliary support roller 65, as illustrated in FIG. 5, is rotatably installed to the lower surface of the detergent receiving case 62 via a hinge 622*k* provided at the lower surface of the detergent receiving case 62.

As such, the moment before the detergent receiving case 62 is completely withdrawn, i.e., the moment before the stopper 622*f* is caught by the front lower end of the water supply unit 63, the auxiliary support roller 65 begins to move while being supported in contact with the inclined guide 61*c*, which prevents the front end of the detergent receiving case 62 from being raised by force applied by the user for the latter half of the withdrawal operation.

As described above, the support roller 64 prevents the front end of the detergent receiving case 62 from sagging and the auxiliary support roller 65 prevents the front end of the detergent receiving case 62 from being raised. That is, both the support roller 64 and the auxiliary support roller 65 may reduce vertical movement of the front end of the detergent receiving case 62 that may be caused during withdrawal or insertion of the detergent receiving case 62, whereby the detergent receiving case 62 may be smoothly withdrawn or inserted in under assistance of the first rail portions 61*b* and the second rail portions 622*a*.

Figure 6:
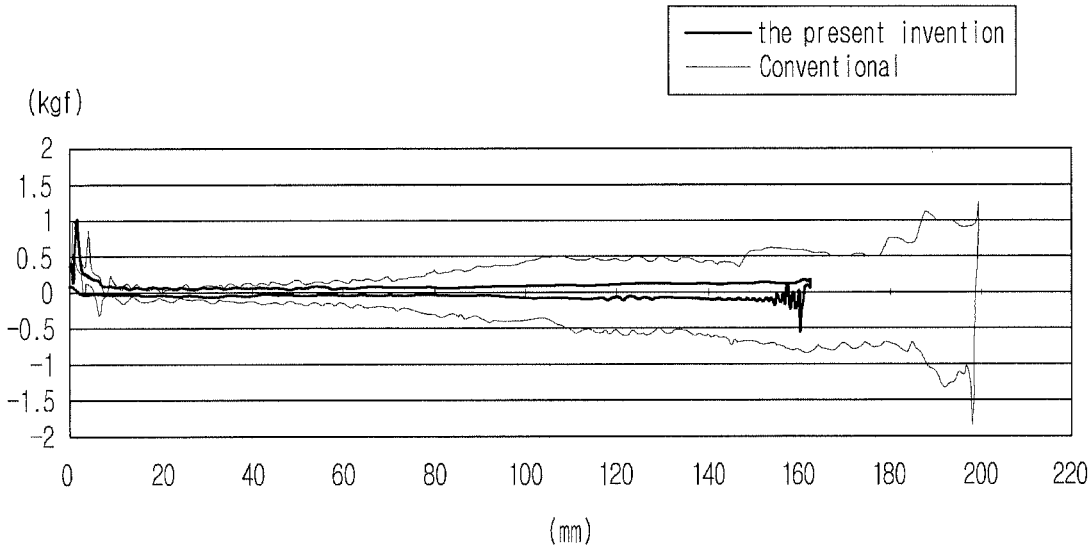
FIG. 6 is a graph comparing force required to open or close the detergent receiving case between an embodiment and the related art.

FIG. 6 is a graph comparing force required to move a conventional detergent receiving case with force required to move the detergent receiving case 62 with the support roller 64 and the auxiliary support roller 65 according to an embodiment. As shown in the graph of FIG. 6, the force required to move the detergent receiving case 62 is significantly reduced as compared to the force required to move the conventional detergent receiving case.

Figure 7:
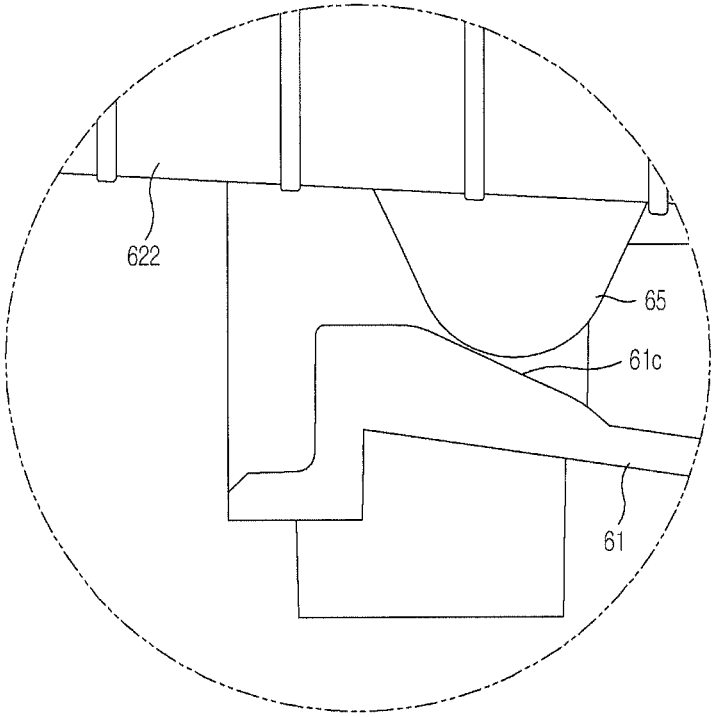
FIG. 7 is a side view illustrating a support part usable with the washing machine according to another embodiment.

As shown in FIG. 2, an embodiment employs the auxiliary support roller 65 as the auxiliary support member 65, but an embodiment is not limited thereto. As illustrated in FIG. 7, the auxiliary support member may includes an auxiliary support portion 65' integrally extending from the lower surface of the detergent receiving case 62 to allow the lower surface of the detergent receiving case 62 to be supported by the inclined guide 61*c*. In this case, a lower end of the auxiliary support portion 65' to be supported by the inclined guide 61*c* may be curved, which is advantageous to reduce friction between the auxiliary support portion 65' and the inclined guide 61*c*.

Figure 8:
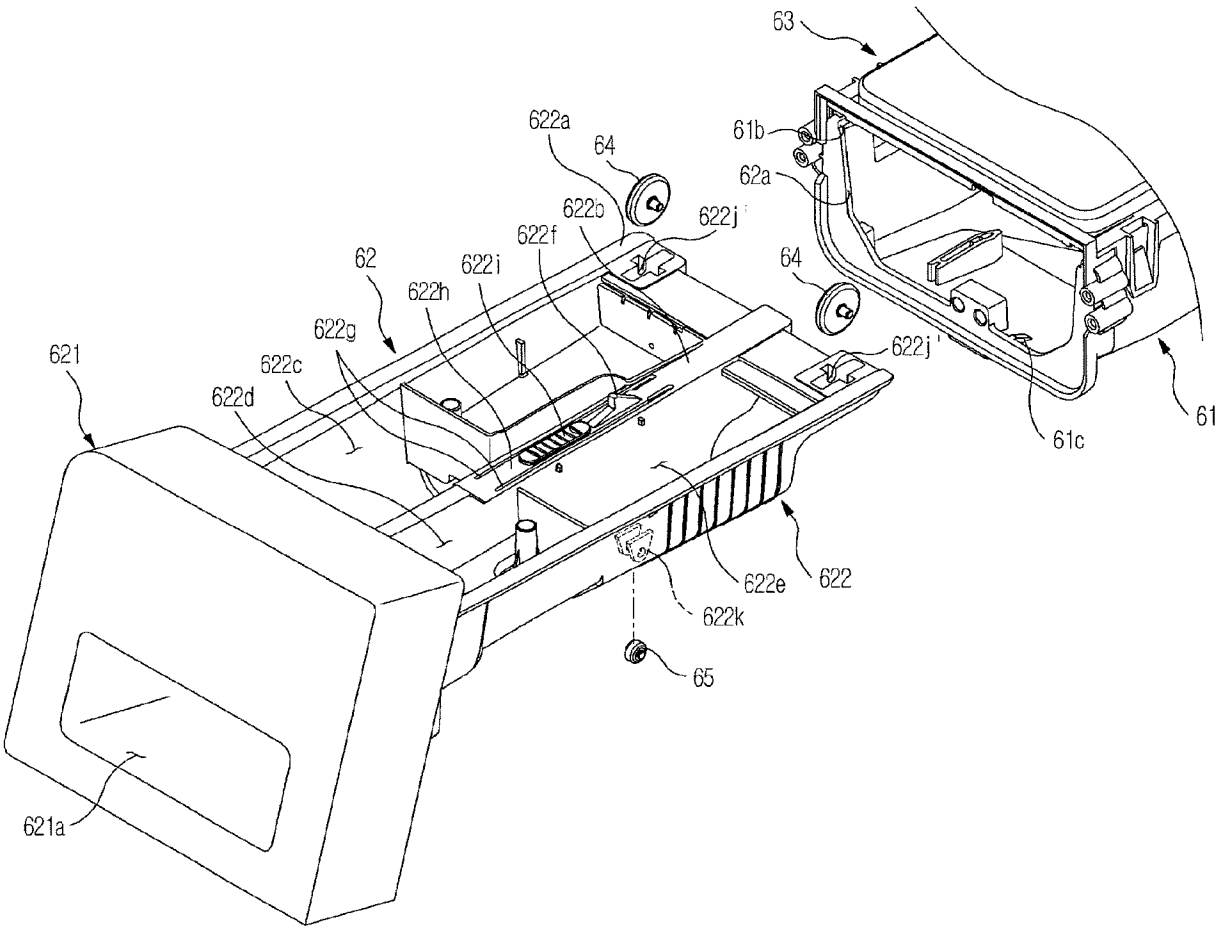
FIG. 8 is a perspective view illustrating a support roller included in the washing machine to an embodiment.

In addition, as shown in FIG. 2, an embodiment employs the single support roller 64 seated in the roller mount 622*j* of the partition 622*b*, but an embodiment is not limited thereto. A plurality of support rollers and corresponding roller mounts may be installed. For example, as illustrated in FIG. 8, roller mounts 622*j'* for installation of the support roller 64 may be provided at opposite lateral positions of the detergent receiving case 62 such that two support rollers 64 are installed in the respective roller mounts 622*j'*. Providing the two support rollers 64 ensures that opposite sides of a rear portion of the detergent receiving case 62 are evenly supported by the two rollers 64, which may prevent left-and-right movement of the detergent receiving case 62.

As is apparent from the above description, according to embodiments, a detergent receiving case is provided with a support roller and an auxiliary support member, which may prevent the detergent receiving case from being raised or sagging when withdrawn. This ensures stable movement of the detergent receiving case and allows the detergent receiving case to be easily moved even by low force.

Although an embodiment has been shown and described, it would be appreciated by those skilled in the art that changes may be made in embodiments without departing from the principles and spirit, the scope of which is defined in the claims and their equivalents.

What is claimed is:

1. A washing machine comprising:

a detergent feeding device to feed detergent, wherein the detergent feeding device includes a detergent housing having an open front side, a detergent receiving case installed to the detergent housing so as to be movable through the open front side of the detergent housing, and a water supply guide unit placed on top of the detergent housing to guide water into the detergent receiving case inserted into the detergent housing, and wherein the detergent receiving case includes at least one support roller supported in a rolling manner on a lower surface of the water supply guide unit, and an auxiliary support member disposed on a lower surface of the detergent receiving case so as to be located forward of the support roller, the auxiliary support member being increasingly supported by an inner bottom surface of the detergent housing as the detergent receiving case is withdrawn from the detergent housing.

2. The washing machine according to claim 1, wherein the auxiliary support member includes an auxiliary support roller supported in a rolling manner on the bottom surface of the detergent housing.

3. The washing machine according to claim 1, wherein the auxiliary support member includes an auxiliary support portion integrally extending from the detergent receiving case.

4. The washing machine according to claim 1, wherein the detergent receiving case includes a partition to divide the interior of the detergent receiving case into left and right regions, and a roller mount indented in the partition for installation of the support roller.

5. The washing machine according to claim 4, wherein the detergent receiving case further includes a stopper located forward of the support roller, the stopper serving to limit a withdrawal distance of the detergent receiving case.

6. The washing machine according to claim 5, wherein the partition includes elongated slots formed in an upper surface thereof at opposite sides of the stopper to extend in a front-and-rear direction thereof.

7. The washing machine according to claim 1, wherein the detergent housing includes first rail portions provided at opposite inner surfaces of the detergent housing, to which the detergent receiving case is movably installed, and wherein the detergent receiving case includes second rail portions provided at opposite outer surfaces thereof so as to be movably installed respective to the first rail portions.

8. The washing machine according to claim 1, wherein the at least one support roller includes two support rollers, and wherein roller mounts for installation of the two support rollers are provided at opposite lateral positions of the detergent receiving case.

9. The washing machine according to claim 1, wherein the detergent housing includes an inclined guide extending forwardly and upwardly from an inner bottom surface of the detergent housing so that the auxiliary support member is supported in contact with the inclined guide.

10. The washing machine according to claim 9, wherein a lower end of the auxiliary support member to be supported in contact with the inclined guide is curved.

11. A washing machine comprising:

a detergent feeding device to feed detergent, wherein the detergent feeding device includes a detergent housing having open front and top sides, a detergent receiving case installed to the detergent housing so as to be movable through the open front side of the detergent housing, the detergent receiving case internally providing a detergent receiving region in which detergent is received, and a water supply guide unit installed to the detergent housing so as to cover the top side of the detergent housing, the water supply guide unit serving to guide water into the detergent receiving region of the detergent receiving case inserted into the detergent housing, wherein the detergent housing includes first rail portions provided at opposite inner surfaces of the detergent housing, to which the detergent receiving case is movably installed, and an inclined guide extending forwardly and upwardly from an inner bottom surface of the detergent housing, and wherein the detergent receiving case includes second rail portions provided at opposite outer surfaces thereof so as to be movably installed respective to the first rail portions, and at least one support roller rotatably installed to the detergent receiving case so as to support a lower surface of the water supply guide unit, and an auxiliary support member rotatably installed at a lower surface thereof so as to be located forward of the support roller, the auxiliary support member being increasingly supported by the inclined guide as the detergent receiving case is withdrawn.

12. The washing machine according to claim 11, wherein the detergent receiving case further includes a stopper to limit a withdrawal distance of the detergent receiving case, and wherein the support roller is placed behind the stopper.

13. The washing machine according to claim 11, wherein the auxiliary support member includes an auxiliary support roller supported in a rolling manner on the inner bottom surface of the detergent housing.

14. A detergent feeding device to feed detergent comprising:

a detergent housing having an open front side;

a detergent receiving case installed to the detergent housing so as to be movable through the open front side of the detergent housing; and a water supply guide unit placed on top of the detergent housing to guide water into the detergent receiving case inserted into the detergent housing, wherein the detergent receiving case includes at least one support roller supported in a rolling manner on a lower surface of the water supply guide unit, and an auxiliary support member disposed on a lower surface of the detergent receiving case so as to be located forward of the support roller, the auxiliary support member being increasingly supported by an inner bottom surface of the detergent housing as the detergent receiving case is withdrawn from the detergent housing.

15. The washing machine according to claim 14, wherein the auxiliary support member includes an auxiliary support roller supported in a rolling manner on the inner bottom surface of the detergent housing.

* * * * *

UNITED STATES PATENT AND TRADEMARK OFFICE

CERTIFICATE OF CORRECTION

PATENT NO. : 8,893,531 B2
APPLICATION NO. : 13/337739
DATED : November 25, 2014
INVENTOR(S) : Il Jun Mun et al.

It is certified that error appears in the above-identified patent and that said Letters Patent is hereby corrected as shown below:

In the Claims

Column 7, Line 12, In Claim 1, delete "on" and insert -- by contacting with --, therefor.
Column 7, Line 22, In Claim 2, delete "the" and insert -- the inner --, therefor.
Column 8, Line 22-23, In Claim 11, delete "portions, and" and insert -- portions, --, therefor.
Column 8, Line 51, In Claim 14, delete "on" and insert -- by contacting with --, therefor.

Signed and Sealed this
Second Day of June, 2015

Michelle K. Lee

Michelle K. Lee
*Director of the United States Patent and Trademark Office*